United States Patent [19]

Membrino

[11] Patent Number: 4,557,384

[45] Date of Patent: Dec. 10, 1985

[54] PAD OF PLASTIC BAGS

[76] Inventor: Hercules Membrino, 280 Paoli Pike, Malvern, Pa. 19355

[21] Appl. No.: 681,541

[22] Filed: Dec. 14, 1984

Related U.S. Application Data

[63] Continuation-in-part of Ser. No. 588,567, Mar. 12, 1984, Pat. No. 4,500,000.

[51] Int. Cl.[4] ..... B65D 85/62

[52] U.S. Cl. ..... 206/554; 206/494; 206/526; 206/806; 383/38

[58] Field of Search ..... 206/449, 494, 526, 554, 206/806; 383/38, 87, 77; 229/69

[56] References Cited

U.S. PATENT DOCUMENTS

| | | | |
|---|---|---|---|
| 2,755,576 | 7/1956 | Golden | 206/806 |
| 3,021,947 | 2/1962 | Sylvester et al. | 206/554 |
| 3,616,991 | 11/1971 | Beck | 206/806 |
| 3,779,139 | 12/1973 | White | 383/77 |
| 3,866,822 | 2/1975 | Faltin et al. | 229/69 |
| 3,985,290 | 10/1976 | Smrt | 206/554 |
| 4,016,977 | 4/1977 | Krautsack | 206/806 |
| 4,154,383 | 5/1979 | Honatzis | 206/554 |
| 4,406,371 | 9/1983 | Membrino | 206/526 |
| 4,420,082 | 12/1983 | Bernie | 206/526 |
| 4,500,000 | 2/1985 | Membrino | 206/526 |

FOREIGN PATENT DOCUMENTS

| | | | |
|---|---|---|---|
| 19431 | 3/1972 | Australia | 206/526 |

*Primary Examiner*—William T. Dixson, Jr.
*Assistant Examiner*—Brenda J. Ehrhardt
*Attorney, Agent, or Firm*—Arthur A. Jacobs

[57] ABSTRACT

A pad of plastic bags comprising a plurality of bag units, each comprising a bag-forming pocket and a selvage portion, the pockets having front and rear walls and sealed edges and the selvage portions being integral with the pockets and also having front and rear walls, the selvage portions being connected to form a base portion, and the units each having a transverse slot forming an open mouth for the pockets and acting to separate the pockets from the base portion.

12 Claims, 11 Drawing Figures

FIG. 4
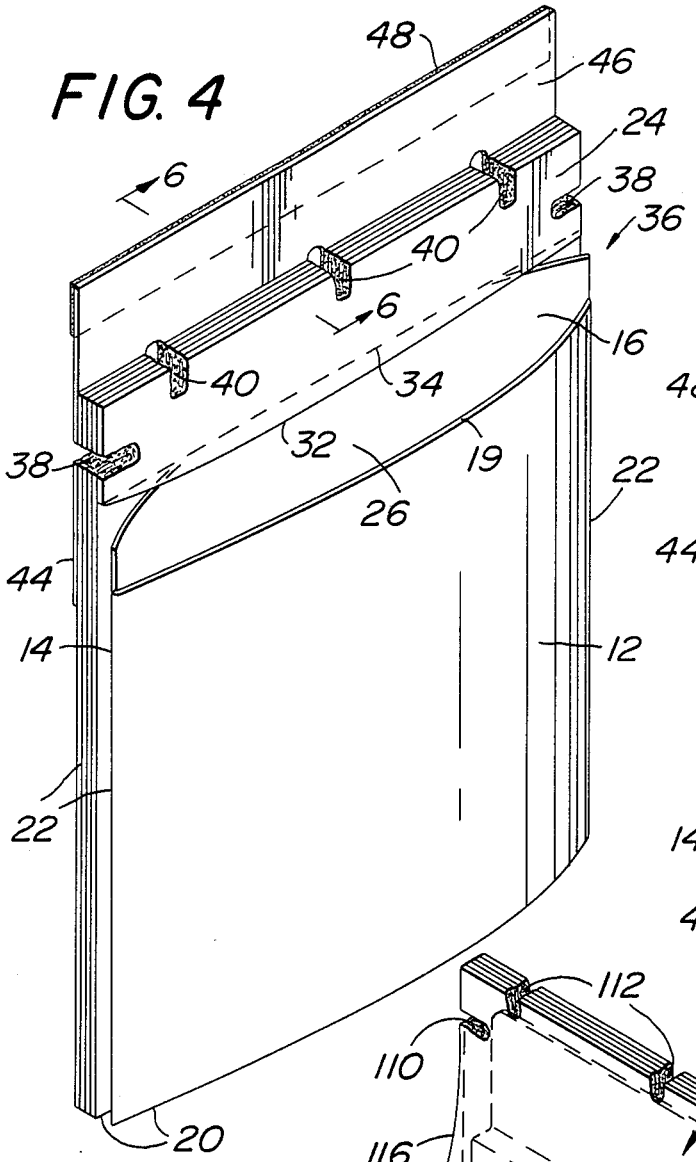
FIG. 6
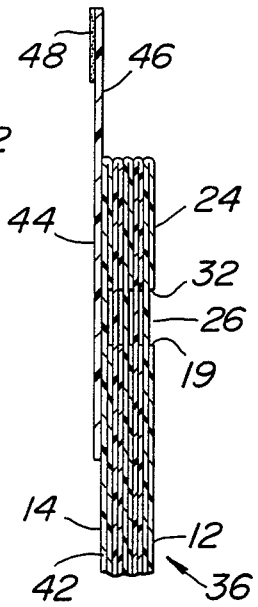
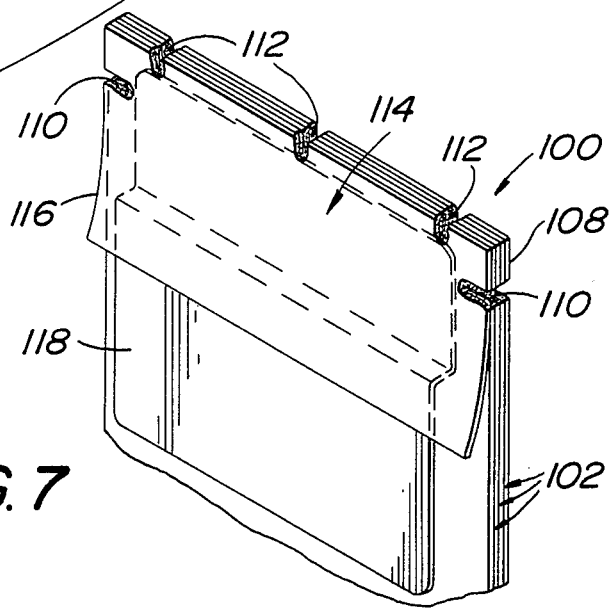
FIG. 7

FIG. 8
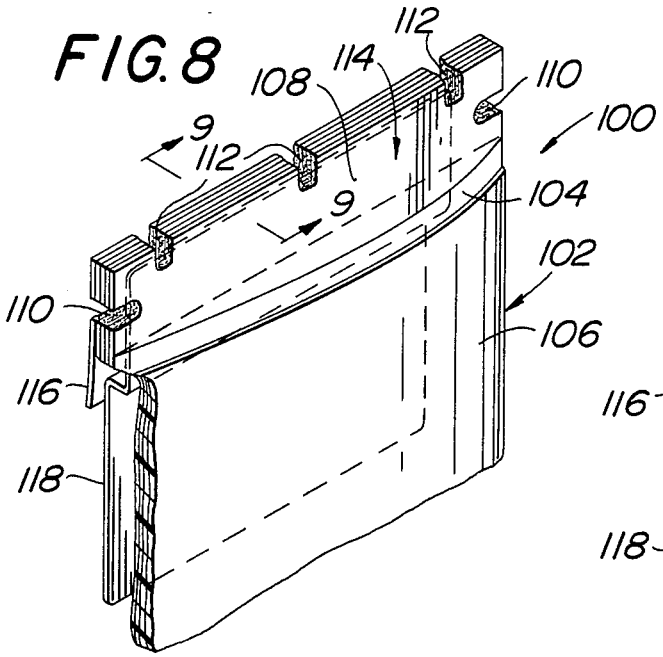
FIG. 9
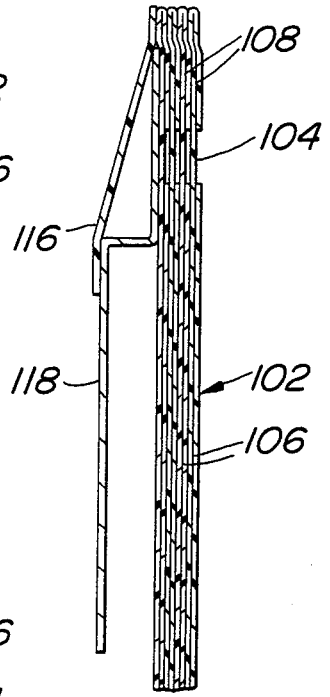
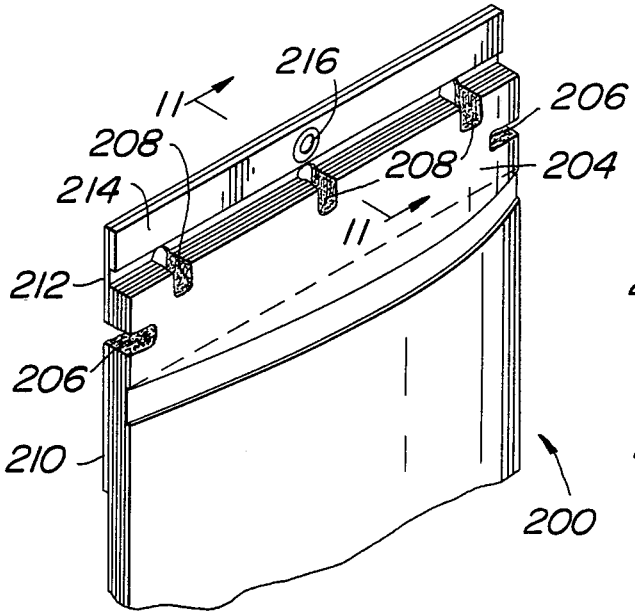
FIG. 10
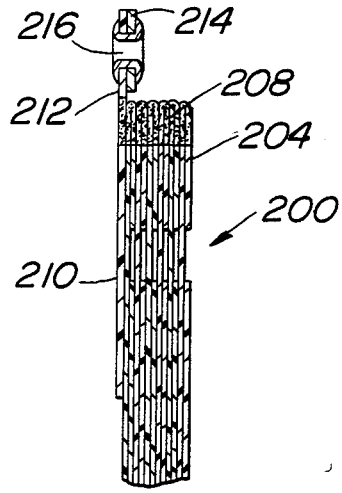
FIG. 11

PAD OF PLASTIC BAGS

This is a continuation-in-part of applicant's copending application Ser. No. 588,567 filed Nov. 12, 1984, now U.S. Pat. No. 4,500,000.

This invention relates to plastic bags, and it particularly relates to packs or pads comprising a plurality of bag units stacked together and commonly secured at a base portion in a manner to permit individual bags to be removed from the pad while the pad itself is supported in place.

The aforesaid parent application discloses a pad of bags of the type disclosed herein with a hanger means having a transverse portion that is arranged to abut the selvage connecting means at the sides of the base portion, whereby the hanger acts not only as a hanger but also as a non-slippable internal supporting means for the base portion. Such internal supporting means was deemed necessary because the parts of the bag-forming pockets that made up the base portion were only extensions of the rear walls of these pockets. These extensions formed single ply walls that had only half the strength of the pockets themselves, where the front and rear walls combined to form what was, in effect, a double ply construction. This was an especially significant problem when very thin plastic material was used since, in such instance, even with the internal support of the hanger, the base portion was still relatively thin and flimsy and could not offer sufficient opposing force when an individual bag was ripped away. Such opposing force is required in order to cause automatic opening of the mouth of the bags when it is pulled away.

In addition, the process of making the above type pad of bags was relatively complicated and expensive because the formation of the lips of the bags and the selvage portions that formed the base portion required very accurate machining to detailed specifications. This also limited the amount of production of the pads.

Another problem heretofore was that the size of the mouths and lips of the pads could not be easily varied. The size of the mouth is often determined by the article to be inserted in the bag, especially in commercial use. A card or other thin object requires only a narrow mouth whereas a larger article, such as an apple or the like, requires a wider mouth. Heretofore, for each size of article to be packed, the plastic film or sheet material had to be especially processed for that size article. This not only increased the complexity and cost of production but also required a large inventory to accomodate a variety of customers.

It was also difficult heretofore to use plastic tubing for manufacturing the bags because of the necessity of providing for the different lengths of the front and rear walls. However, if it is possible to use tubing, it makes the process easier and less expensive.

It is an object of the present invention to overcome the above and other problems by providing a pad of bags with a base portion of relatively great strength even when very thin or flimsy plastic material is used.

Another object of the present invention is to provide a base portion which has a significant strength relative to the individual bags whereby a sufficient amount of opposing force is provided to cause opening of the bags as they are torn away from the pad.

Another object of the present invention is to obviate the necessity of using stiffening supports in the base portion or of separate hanger means.

Another object of the present invention is to provide a method of forming the mouth, lip and selvage portions of the bag in a simple and inexpensive manner.

Another object of the present invention is to provide a method of forming the mouths, lips and selvage portions of the bags in such a manner that the size of the mouth can be varied in accordance with the type of article to be inserted into the bag.

Another object of the present invention is to be capable of using plastic tubing instead of sheet material that has to be pre-folded and pre-processed.

Other objects and many of the attendant advantages of this invention will be readily appreciated as the same becomes better understood by reference to the following description when read in conjunction with the accompanying drawings wherein:

FIG. 4 is a front perspective view of a pad of bags of the type shown in FIGS. 1, 2 and 3.

FIG. 6 is a sectional view taken on line 6—6 of FIG. 4.

FIG. 7 is a fragmentary rear perspective view of another type of pad embodying the present invention.

FIG. 8 is a fragmentary front perspective view of the pad of FIG. 7.

FIG. 9 is a sectional view taken on line 9—9 of FIG. 8.

FIG. 10 is a fragmentary front perspective view of yet another form of the invention.

FIG. 11 is a sectional view taken on line 11—11 of FIG. 10.

Figure 1:
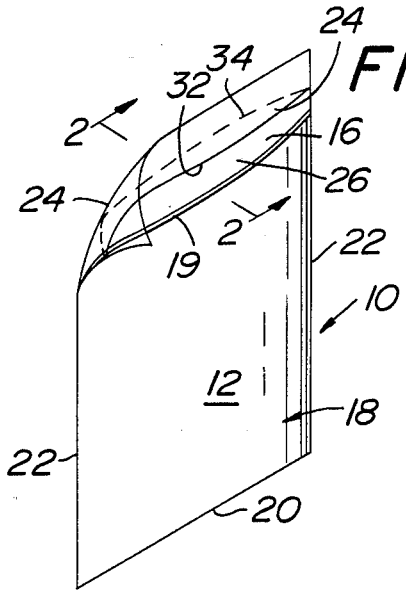
FIG. 1 is a front perspective view of a plastic bag embodying the present invention.
Figure 2:
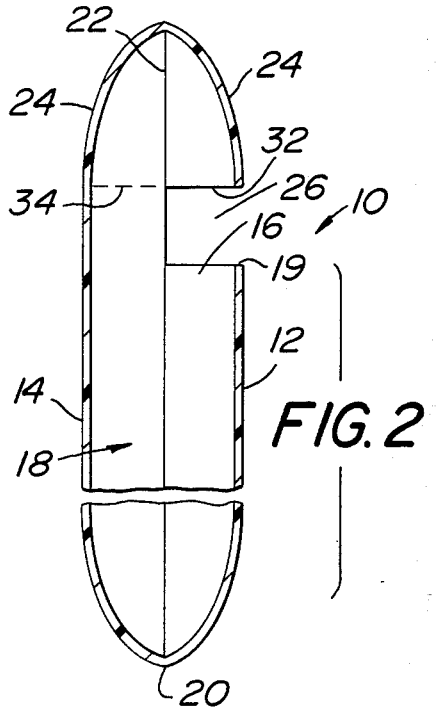
FIG. 2 is a sectional view taken on line 2—2 of FIG. 1.
Figure 3:
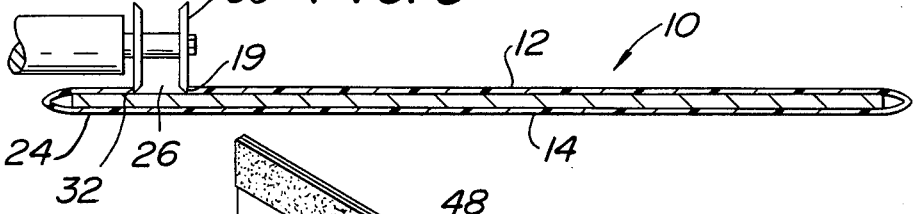
FIG. 3 is a sectional view showing one manner of forming the mouth, lip and selvage portion of the bag.

Referring in greater detail to the drawings wherein similar reference characters refer to similar parts, there is shown a plastic unit, generally designated 10, comprising a front wall 12, a rear wall 14, a mouth 16 of the resultant bag-forming pocket 18, with a lip being shown at 19, a sealed lower edge 20, sealed side edges 22 and a selvage portion 24. The selvage portion 24 is a double-walled extension of the front and rear walls of the pocket 12 and is formed by cutting a slot 26 in the front wall of a plastic tube that is sealed at both ends. An example of the cutting of such slot is illustrated in FIG. 3, where a double-bladed cutting tool 30 is used. The slot forms both the lip, defined by the lower edge 19 of the slot, and the selvage portion, defined by the upper edge 32 of the slot. A score line 34 is the cut into the selvage portion, as best shown in FIG. 1.

Figure 5:
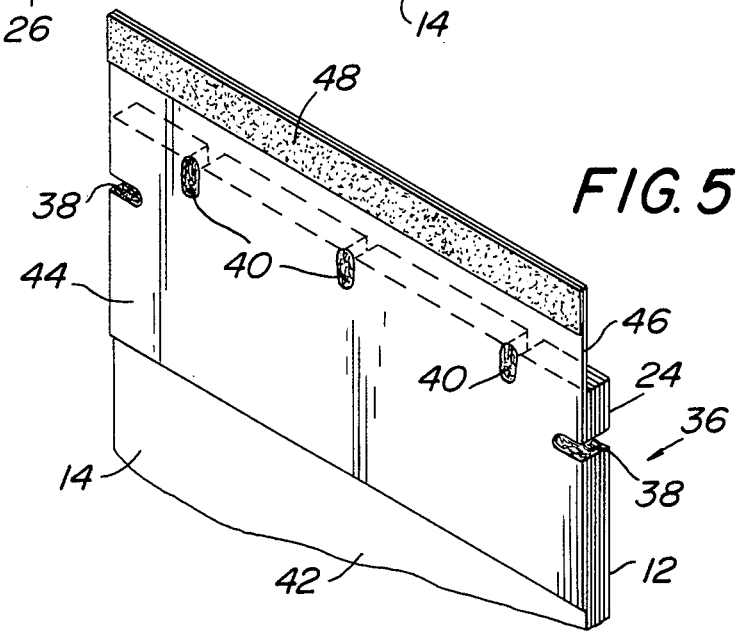
FIG. 5 is a fragmentary rear perspective view of the pad of FIG. 4.

FIGS. 4, 5 and 6 show the pockets or units 10 stacked to form a pad of bags, the pad being generally designated 36. The pad 36 is formed generally in the manner described in the aforesaid application Ser. No. 588,567 whereby the selvage portions are heat-sealed or welded together at their top edges, as at 40. It is, of course, possible to use other securing means such as clamps, adhesive, rivets, etc., but heat-sealing is preferred. The combined selvage portions form the base portion 42.

The pad 36, is provided with a rear skirt or flap 44 which is attached to the base portion 42 by the same heat seals 38 and 40 that are used to attach the selvage portions together.

The flap 44 may be made of the same or different weight plastic than the pockets 10 and extends up above the upper edge of the base portion to form a ledge or hanger portion 46. Optionally, an adhesive strip 48 may be provided along the upper rear edge portion of the hanger portion 46. Any other desired hanging means may be substituted, such as an aperture to receive a hook or the like. The hanger may optionally also be reinforced, if so desired, by a strip of rigid material or any other desired means.

The flap 44 and its hanger portion 46 constitute both an additional support for the base portion, which is already of relatively good strength because of the two-ply construction of the selvage portions, and a built-in hanger means, thereby considerably reducing the cost of materials and manufacturing which is inherent in the use of separate reinforcing and hanging materials. In this respect, since it is made of the same or similar plastic material as the remainder of the pad, it can be attached in the same heat-sealing operation used to weld the selvage portions together. The hanger portion does not even require a wall support since it can be held in one hand while the other hand is used to pull off a bag.

An alternative form of the invention is shown in FIGS. 7, 8 and 9. In this form, the pad, generally designated 100, is the same as in FIGS. 4, 5 and 6 in that it comprises a stack of plastic units 102, each having a transverse slot 104 in its front wall to form an open mouth and to divide the unit into a bag-forming pocket 106 and a selvage portion 108. The units are held together by welds 110 at the sides and by welds 112 at the upper edges to form a base portion 114.

A skirt or flap of the same or different weight plastic material is provided at 116, this flap being heat-sealed to the base portion by the same welds that hold the selvage portions together. However, the flap 116 does not have an upstanding hanger extension. Instead, it permits insertion of a rigid support 118, made of metal, cardboard, wood or any other desired rigid material. The upper end of this support 118 is releasably but securely held between the flap 116 and the base portion 114.

Another alternative form of the invention is shown in FIGS. 10 and 11 where the pad, generally designated 200, is the same as that shown in FIGS. 4, 5 and 6, including the pockets and the selvage portions 204 which are welded together at 206 and 208 to form the base portion. The flap 210, which is secured to the base portion by the same welds 206 and 208, has an upstanding hanger portion 212 to which is secured a rigid reinforcing strip 214 of any desired material such as cardboard, paper, plastic, or the like. An aperture 216, in the form of a grommet or the like, extends through the hanger and its reinforcing strip for receiving a hook or the like. This type of construction is especially suitable when very thin or flimsy plastic material is used for the flap.

Although the construction of the units so far described has been in the form of flexible plastic tubing, it is possible, though less preferable, to use flat sheets of plastic, pre-fold them to form the front and rear walls and then seal the edges of the folded sheets. These pre-processed units can then be processed in the manner disclosed above to form the units and then the pads.

Furthermore, although heat-sealed welds are illustrated on the upper edge of the base portion, and although there upper edge connections are preferably used, it is possible to omit them and to utilize only the welds at the side edges of the base portion since these side edge connections have a significant effect on the opening of the bags as they are torn away.

The invention claimed is:

1. A pad of plastic bag units, said units being stacked to overly each other and being separably connected by a common base portion, each unit comprising a bag-forming pocket and a selvage portion, said pocket having a front wall, a rear wall, sealed side edges, a sealed bottom edge remote from said selvage portion and a cutaway portion of said front wall forming an open mouth of said pocket and having an upper edge adjacent said selvage portion, said selvage portion having front and rear walls to form a double-ply construction, and a line of weakness extending laterally from the top edge of said cutaway portion across the rear wall forming a continuous lateral line of severance defined by the top edge of said cutaway portion and said line of weakness, whereby said selvage portion fully retains its double-ply structure when said pocket is severed therefrom, a free edge in spaced parallel relation to the mouth of the pocket and side edges in common with the side edges of said pocket, the selvage portions of all the stacked units being secured together by common side securing means at the side edges thereof to form said common base portion, the free edges of said selvage portions forming a free edge of said common base portion.

2. The pad of claim 1 wherein said common base portion is provided with a support means.

3. The pad of claim 2 wherein said support means comprises a flap attached to the common base portion by said common side securing means.

4. The pad of claim 3 wherein said flap has an upstanding portion extending beyond the free edge of said common base portion to form a supporting surface.

5. The pad of claim 4 wherein said supporting surface is provided with securing means to releasably secure it to a support.

6. The pad of claim 5 wherein the securing means is an adhesive strip.

7. The pad of claim 3 wherein the flap is in engagement with a supporting stand of rigid material.

8. The pad of claim 3 wherein the flap is provided with a strip of substantially rigid material.

9. The pad of claim 3 wherein said flap is made of the same plastic material as the units.

10. The pad of claim 1 wherein the pocket and the selvage portion in each unit are integral with each other, having common front and rear walls and common side edges, and a transverse slot in the common front wall, said slot forming the cutaway portion and acting to separate the pocket from the selvage portion.

11. The pad of claim 10 wherein the units are of tubular construction.

12. The pad of claim 10 wherein the units are made of pre-folded and pre-formed sheet material.

* * * * *